US006069446A

United States Patent [19]

Kim

[11] Patent Number: 6,069,446

[45] Date of Patent: May 30, 2000

[54] PLASMA DISPLAY PANEL WITH RING-SHAPED LOOP ELECTRODES

[75] Inventor: Jae Gak Kim, Kyungsangbuk-do, Rep. of Korea

[73] Assignee: Orion Electric Cp., Ltd., Gumi, Rep. of Korea

[21] Appl. No.: 09/000,608

[22] Filed: Dec. 30, 1997

[30] Foreign Application Priority Data

Jun. 30, 1997 [KR] Rep. of Korea ..... 97-28937

[51] Int. Cl.[7] ..... H01J 17/49

[52] U.S. Cl. ..... 313/582; 313/584; 313/486

[58] Field of Search ..... 313/581, 582, 313/584, 586, 155

[56] References Cited

U.S. PATENT DOCUMENTS 3,706,912 12/1972 Ikegami ..... 313/155
4,737,686 4/1988 Harvey ..... 313/584
5,061,876 10/1991 Park ..... 313/581
5,825,128 10/1998 Betsui et al. ..... 313/584

*Primary Examiner*—Vip Patel
*Attorney, Agent, or Firm*—Jacobson, Price, Holman & Stern, PLLC

[57] ABSTRACT

A plasma display panel including a pair of spaced substrates defined with a discharge space therebetween, and two groups of electrodes respectively arranged on the substrates in such a manner that they intersect each other while facing each other, wherein the electrodes included in one of the electrode groups have ring-shaped loops arranged in pixel regions, respectively, and alternating current is applied to the loop electrodes. When alternating current is applied to the loop electrodes, a magnetic field is formed around the loop of each loop electrode. The magnetic fluxes of the magnetic field form an electric field while passing through a discharge space defined in each pixel region. Accordingly, particles of discharge gas are charged.

3 Claims, 4 Drawing Sheets

PLASMA DISPLAY PANEL WITH RING-SHAPED LOOP ELECTRODES

BACKGROUND OF THE INVENTION

1. Field of the Invention

The present invention relates to a plasma display panel, and more particularly to a face discharge type plasma display panel.

2. Description of the Prior Art

Plasma display panels, which utilize a gaseous discharge phenomenon, basically include DC type plasma display panels in which selection of pixels is provided by two groups of electrodes arranged in such a manner that they intersect with each other while facing each other. However, such DC type plasma display panels exhibit low luminance because they exhibit a delayed discharge initiation while performing a discharge operation only when desired pixels are selected. For this reason, it is impossible to display moving pictures in a high resolution using DC type plasma display panels.

In order to achieve a rapid discharge initiation and a memory effect (namely, a continued discharge even when no pixel is selected), a variety of plasma display panels have been proposed. For example, AC type plasma display panels and hybrid plasma display panels have been proposed.

In Face discharge type plasma display panels which are a kind of AC type plasma display panels, a discharge operation is initiated between facing electrodes. After the discharge initiation, the discharge is maintained by adjacent electrodes arranged on the same substrate. Accordingly, such face discharge type plasma display panels obtain a high luminance, as compared to conventional plasma display panels in which a discharge occurs mainly at intersections of electrodes.

Referring to FIG. 1, a general configuration of a face discharge type plasma display panel is shown. As shown in FIG. 1, the face discharge type plasma display panel includes a pair of spaced substrates P1 and P2 respectively having electrodes E1 and E2. The electrodes E1 and E2 are arranged in such a manner that they intersect with each other while facing each other. A dielectric layer I is formed over the substrate P1 in such a manner that the electrodes E1 formed on the substrate P1 are buried in the dielectric layer I. A fluorescent layer F is formed over the substrate P2 in such a manner that the electrodes E2 formed on the substrate P2 are buried in the fluorescent layer F. In FIG. 1, the reference character "R" denotes partitions for partitioning pixels.

The plasma display panel includes at least two electrodes E1 (namely, E1*a* and E1*b*) buried in the dielectric layer I. Where the plasma display panel includes two maintenance electrodes E1*a* and E1*b*, it is called a "three-electrode type plasma display panel". Where the plasma display panel includes three maintenance electrodes, it is called a "four-electrode type plasma display panel".

In such a face discharge type plasma display panel, one of the maintenance electrodes E1*a* and E1*b* generates an initial discharge along with the electrode E2 facing the maintenance electrodes. Following this initial discharge, a maintenance discharge occurs between the maintenance electrodes E1*a* and E1*b*. Thus, a continued discharge is achieved. Accordingly, this face discharge type plasma display panel exhibits high luminance because the discharge is maintained with high luminous strength for a lengthened period of time.

However, conventional face discharge type plasma display panels have several problems to be solved.

Where the fluorescent layer F is to be formed on the front substrate P1, it should have the form of a thin filter. In this case, accordingly, there is a difficulty in the fabrication. Where a plurality of maintenance electrodes are formed on the rear substrate P2 on which partitions R are also formed, the rear substrate P2 has a very complex structure. For this reason, reflection type plasma display panels have been generally used in which the maintenance electrodes E1 and dielectric layer I are formed on the front substrate P1 whereas the fluorescent layer F is formed on the rear substrate P2.

In this structure, however, the front substrate P1, which are directed to the eyes of the user, are partially shielded by the dielectric layer I and the maintenance electrodes E1*a* and E1*b*. This results in a great decrease in the open area ratio of this structure. As a result, it is impossible to obtain a great enhancement in luminance, in spite of an enhancement in luminous strength. In particular, although the four-electrode type plasma display panel including three maintenance electrodes employs a luminance enhancing configuration involving a complexity in configuration and a great increase in the manufacturing costs, it obtains a luminance only slightly higher than that obtained in the three-electrode type plasma display panel.

Basically, the maintenance discharge carried out between the maintenance electrodes in the conventional face discharge type plasma display panel is an AC discharge carried out through the dielectric layer I. In other words, the maintenance discharge is not directly carried out between the two maintenance electrodes E1*a* and E1*b*. A process, which involves the steps of forming wall charge on the surface of the dielectric layer I and generating a kind of electron avalanche, is repeatedly carried out between the maintenance electrodes in order to supply charge into a discharge space. Thus, a plasma discharge occurs.

As apparent from the above description, the conventional face discharge plasma display panel has an operation principle in which its two maintenance electrodes E1*a* and E1*b*, between which the dielectric layer I is interposed as shown in FIG. 2, form a capacitor, thereby generating a kind of AC discharge. Therefore, this face discharge plasma display panel may be considered to be a capacitive coupling plasma display panel.

As well known, AC discharge does not exhibit a high discharge strength. For this reason, the conventional face discharge type plasma display panel obtains a low plasma density of about $10^{10}/cm^2$. This value corresponds to only several times the ionization rate of AC type plasma display panels. Furthermore, such a capacitive coupling plasma display panel forms a capacitor having a large capacitance by itself. As a result, a great increase in parasitic capacitance occurs. This interferes with a rapid driving of the panel.

SUMMARY OF THE INVENTION

Therefore, an object of the invention is to solve the above-mentioned problems involved in the conventional face discharge type plasma display panel and to provide a plasma display panel having a simple structure capable of not only preventing a decrease in open area ratio, but also achieving a simple driving, an increase in ionization rate and an increase in plasma density while preventing generation of undesirable effects such as formation of a parasitic capacitance.

In accordance with the present invention, this object is accomplished by providing a plasma display panel including a pair of spaced substrates defined with a discharge space therebetween, and two groups of electrodes respectively arranged on the substrates in such a manner that they intersect each other while facing each other, wherein the electrodes included in one of the electrode groups have ring-shaped loops arranged in pixel regions, respectively, and alternating current is applied to the loop electrodes.

When alternating current is applied to the loop electrodes, a magnetic field is formed around the loop of each loop electrode. The magnetic fluxes of the magnetic field form an electric field while passing through a discharge space defined in each pixel region. Accordingly, particles of discharge gas are charged.

In the plasma display panel of the present invention, discharge gas is ionized in accordance with an inductive coupling manner, which is different from the conventional method using a capacitive coupling, to form plasma. Accordingly, the plasma display panel of the present invention has a simple configuration. The operation of this plasma display panel is also simplified. It is also possible to obtain a very high plasma density. This enables a great improvement in discharge strength and a great increase in the open area ratio.

BRIEF DESCRIPTION OF THE DRAWINGS

Other objects and aspects of the invention will become apparent from the following description of embodiments with reference to the accompanying drawings in which:

FIGS. 7 and 8 are views respectively illustrating another embodiment of the plasma display panel according to the present invention, in which FIG. 7 is a plan view whereas FIG. 8 is a sectional view.

DESCRIPTION OF THE PREFERRED EMBODIMENTS

Figure 1:
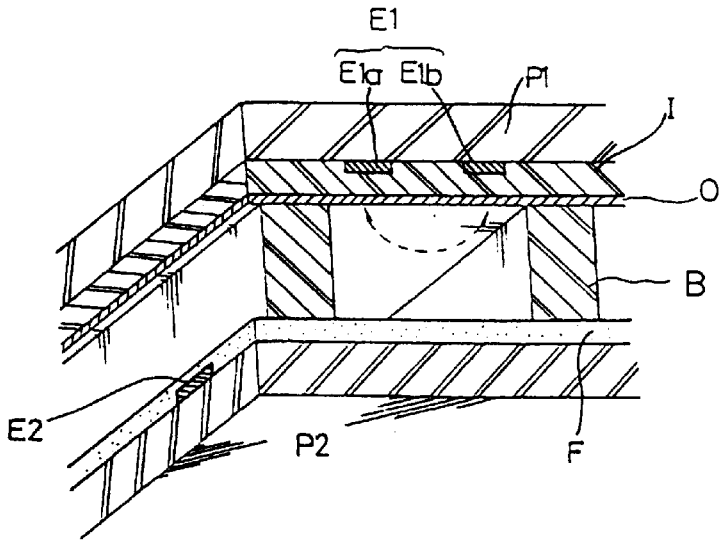
Fig.1 (prior art)
FIG. 1 is a fragmentary perspective view of a conventional face discharge type plasma display panel.
Figure 2:
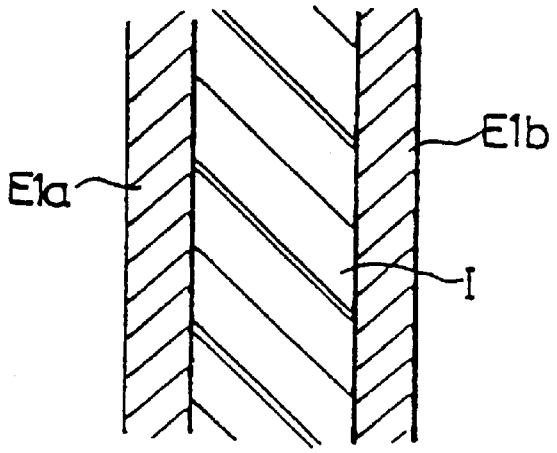
Fig.2 (prior art)
FIG. 2 is a sectional view illustrating a problem involved in the convention face discharge type plasma display panel.
Figure 3:
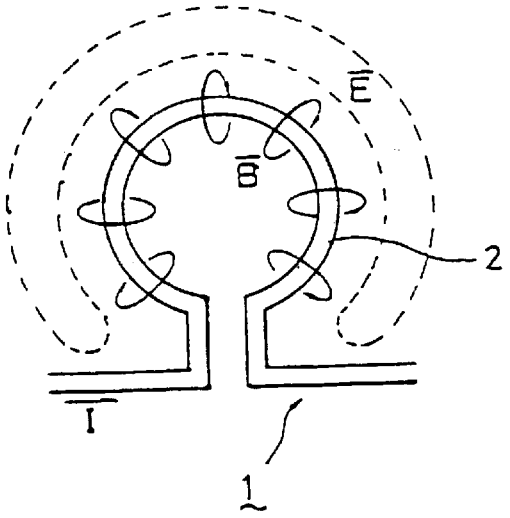
FIG. 3 is a schematic view illustrating the operation principle of a plasma display panel according to the present invention.

FIG. 3 illustrates the operation principle of a plasma display panel according to the present invention.

As shown in FIG. 3, the plasma display panel of the present invention includes an electrode 1 having a ring type loop 2. The electrode 1 is arranged at every pixel position. The loop 2 is formed by extending the electrode 1. Accordingly, the loop 2 has not a complete ring shape, but has a "Ω" shape.

When alternating current I is applied to the electrode 1 having the loop 2 (hereinafter, this electrode is referred to as a loop electrode), a magnetic field, bar-capped B, is generated around the loop 2. This magnetic field, bar-capped B, has circumferential magnetic fluxes arranged around the loop 2.

Since the loop electrode 1 is formed on one of substrates included in the plasma display panel, namely, a substrate P1 or P2, at least ½ of the magnetic fluxes of the magnetic field, bar-capped B, passes through a discharge space. By this magnetic fluxes, discharge gas existing in the discharge space is charged. That is, the discharge gas is ionized, thereby forming plasma. In other words, the alternating current I flowing through the loop electrode 1 generates a magnetic field, bar-capped B, which then charges discharge gas, thereby ionizing the same discharge gas. Since the ionized gas is plasma, it can be considered that an electric field, bar-capped E, formed in the discharge space forms a plasma zone.

The plasma display panel of the present invention using the loop electrode 1 may be considered to be an inductive coupling plasma display panel which is compared to the convention capacitive coupling plasma display panel. In the case of the inductive coupling plasma display panel, energy supplied by the alternating current 1 can be approximately completely used as energy for ionizing the discharge gas, except for its loss caused by a turbulence. Accordingly, high efficient discharge can be achieved.

After conducting a test for determining basic physical properties of the plasma display panel according to the present invention, it could be found that the plasma display panel of the present invention exhibits a great increase in plasma density to $10^{11}$ to $10^{12}/cm^2$ at voltage of 200 to 400 V used in the conventional face discharge type plasma display panel. This value corresponds to several ten times to several hundred times the maximum plasma density of $10^{10}/cm^2$ of the conventional face discharge type plasma display panel.

Figure 4:
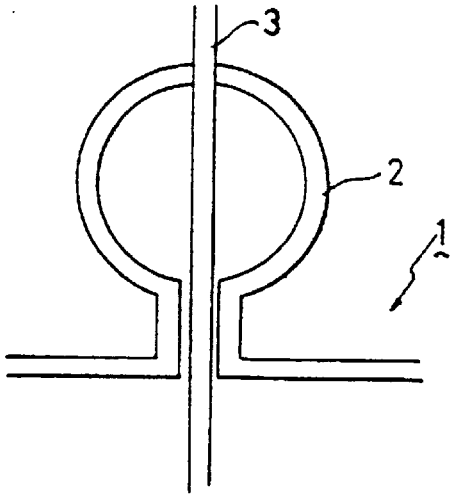
FIG. 4 is a plan view illustrating an arrangement of electrodes in the plasma display panel according to the present invention.

In accordance with the present invention, the loop electrodes 1 may have a variety of arrangements to constitute a plasma display panel. FIG. 4 illustrates an example of a loop electrode arrangement in which the loop electrodes 1 are arranged in such a manner that they intersect simply stripe electrodes 3 having a conventional structure while facing each other. An initiative discharge for the selection of a desired pixel occurs between a desired loop electrode 1 and a stripe electrode 3 associated with the loop electrode 1. On the other hand, a maintenance discharge, namely, supplying of charge to discharge gas, is conducted only by the loop electrode 1.

Figure 5:
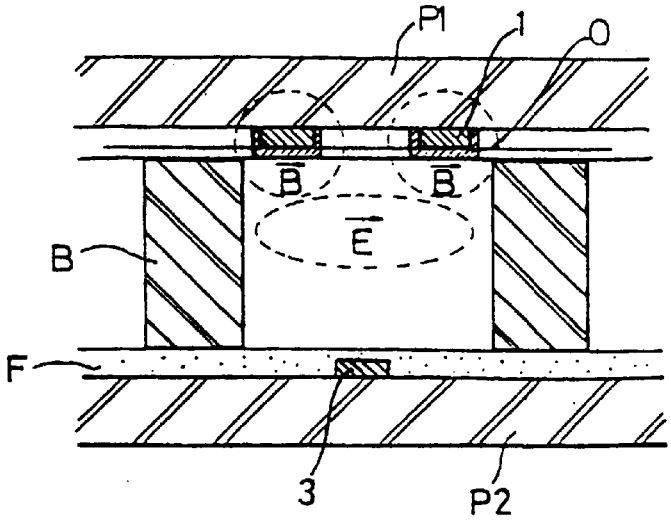
FIGS. 5 and 6 are sectional views respectively illustrating different embodiments of the plasma display panel according to the present invention.
Figure 6:
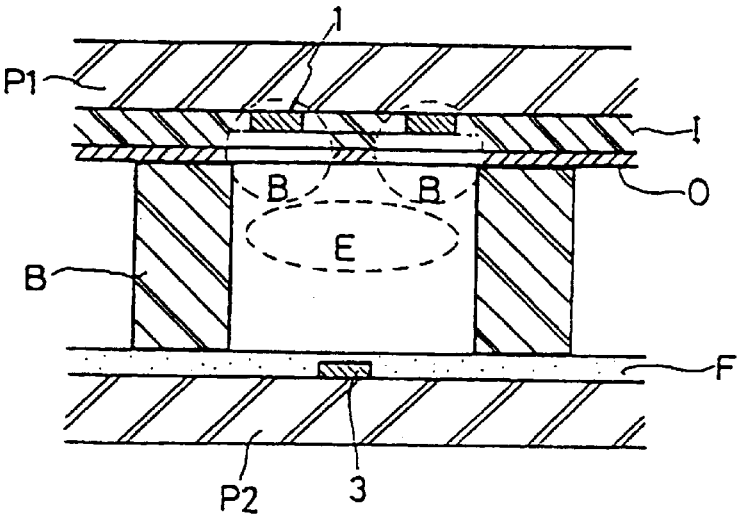

FIGS. 5 and 6 illustrate different embodiments of plasma display panels which use the electrode arrangement of FIG. 4, respectively. First, the configuration of FIG. 5 will be described.

The plasma display panel shown in FIG. 5 includes a pair of spaced substrates P1 and P2 defined with pixels by partition walls B. Discharge gas is filled in a space defined between the substrates P1 and P2. Two groups of electrodes 1 and 3 are arranged on the substrates P1 and P2, respectively, in such a manner that they intersect each other while facing each other. In the illustrated case, the electrodes 1 formed on the substrate P1 serve as loop electrodes having a structure according to the present invention whereas the electrodes 3 formed on the substrate P2 serve as stripe electrodes having a general structure.

A fluorescent layer F is formed over the rear substrate P2 in such a manner that the electrodes 3 are buried in the fluorescent layer F. Of course, the loop electrodes 1 may be formed on the rear substrate P2. However, it is preferred that the loop electrodes 1 be arranged on the front substrate P1 because the loop electrodes 1 in each pixel region are spaced from each other to define a central space while the stripe electrode 3 in the same pixel region extends along the central space.

Where the loop electrodes 1 are arranged on the front substrate P1, they may be comprised of transparent electrodes made of indium tin oxide (ITO). Alternatively, the loop electrodes 1 may be comprised of metal electrodes because they define a central space therebetween in such a manner that they allow visible rays to pass through the central space. Where the loop electrodes 1 are comprised of metal electrodes, they preferably contain a magnetically permeable material such as ferrite in order to achieve an improvement in the strength of a magnetic field, bar-capped B, generated, namely, an improvement in the magnetic flux density.

Where the loop electrodes 1 are formed in accordance with a general printing method, a protection layer O is preferably formed over the surface of each loop electrode in order to prevent the loop electrode from being damaged due to an ion bombardment of plasma. The formation of the protection layer may be achieved by depositing a thin film made of a material such as MgO over the loop electrodes 1 in accordance with a conventional method.

In the embodiment of FIG. 5, the loop electrodes 1 operate to generate an initiative discharge, along with the stripe electrode 3 associated therewith. After generating the initiative discharge, the loop electrodes 1 continuously operate to generate a maintenance discharge.

On the other hand, in accordance with the embodiment of FIG. 6, a dielectric layer I is formed over the front substrate P1 in such a manner that the loop electrodes 1 are buried in the dielectric layer I. A protection layer O is also formed over the dielectric layer I. This embodiment is adapted to further enhance the plasma density by forming an electric field in the discharge space in accordance with the principle of the inductive coupling plasma display panel of the present invention while forming wall charge on the surface of the dielectric layer I. Accordingly, the plasma display panel according to this embodiment may be considered to be a hybrid plasma display panel having a combined configuration of the inductive and capacitive coupling plasma display panels.

Figure 7:
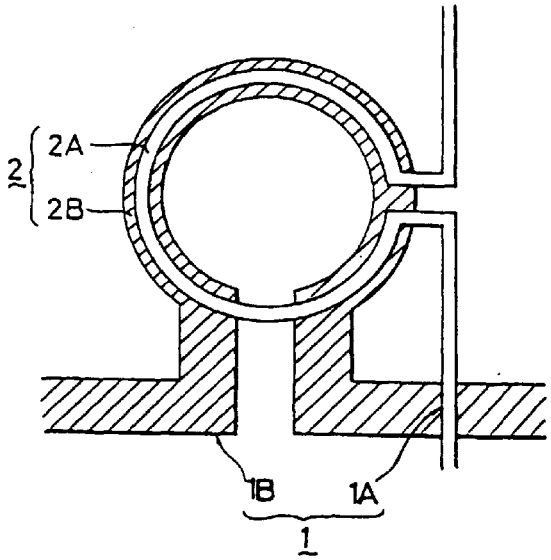

Alternatively, the loop electrodes 1 may be formed on both the substrates P1 and P2, respectively, in such a manner that they face each other, as shown in FIG. 7. In this case, the loop electrodes 1A formed on one of the substrates intersect the loop electrodes 1B formed on the other substrate in such a manner that their loops 2A and 2B face each other. By virtue of such an arrangement, the loop electrodes 1A and 1B can be simply driven in a matrix manner. Although the loop electrode 1B formed on the rear substrate is shown as having a thickness greater than that of the loop electrode 1A formed on the front substrate, such a thickness difference between the loop electrodes 1A and 1B is only to distinguish the overlapping loop electrodes from each other in FIG. 7. It is technically unnecessary to provide loop electrodes having different thicknesses.

Figure 8:
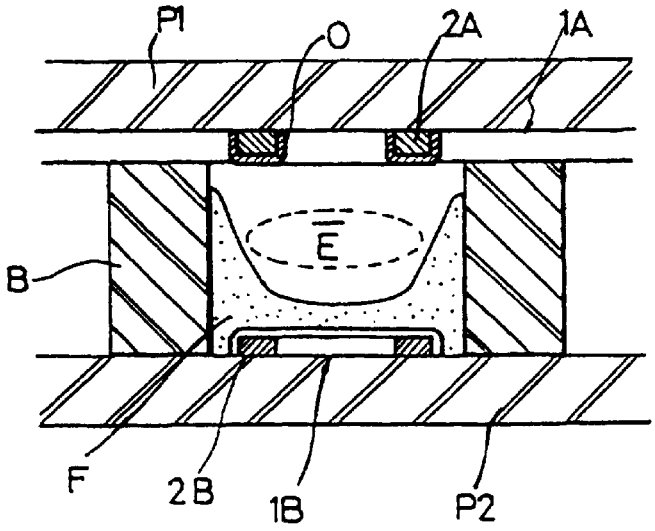

FIG. 8 illustrates a plasma display panel having the configuration shown in FIG. 7. As shown in FIG. 8, the plasma display panel includes loop electrodes 1 (namely, 1A and 1B) respectively arranged on facing substrates P1 and P2 in such a manner that they intersect each other while facing each other. A fluorescent layer F is formed on one of the substrates P1 and P2 (in the illustrated case, the substrate P2) at each pixel region. If necessary, a protection layer O may be formed over the other substrate, namely, the substrate P1. In order to obtain a maximum light emitting area, the fluorescent layer F has a U-shaped cross section.

When alternating current is applied to one of the loop electrodes 1A and 1B in the configuration of FIG. 8, a magnetic field is formed in the discharge space defined between the substrates P1 and P2, thereby inducing an electric field, bar-capped E. The strength of the electric field, bar-capped E, and thus the plasma density may vary in accordance with voltages respectively applied to the loop electrodes 1A and 1B and the timing of the voltage application. Accordingly, it is possible to achieve a gray scale display for pixels in the case of FIG. 8.

As apparent from the above description, the present invention provides a plasma display panel in which a maintenance discharge is obtained only using loop electrodes having a simple configuration including a loop arranged in a pixel region. Accordingly, the plasma display panel of the present invention has a simple configuration. The operation of this plasma display panel is also simplified. Since the loops of the loop electrodes in each pixel region are spaced to define a central space, there is no degradation in the open area ratio even when the loop electrodes are arranged on the front substrate. Therefore, there is no degradation in luminance.

The most important advantage of the present invention is an inductive discharge capable of obtaining a very high plasma density. This enables a great improvement in discharge strength, a reduction in the drive voltage, and a reduced voltage consumption. Furthermore, there is no undesirable phenomenon such as the formation of parasitic capacitance. Consequently, it is possible to effectively and rapidly display moving pictures in a high resolution.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A plasma display panel, comprising:

a) first and second substrates that are spaced apart so as to define a discharge space therebetween; and b) first and second electrodes including respective ring-shaped loops disposed in a pixel region and arranged on the respective first and second substrates to face each other across the discharge space and to overlap each other, the first and second electrodes adapted to receive alternating current applied thereto.

2. A plasma display panel, comprising:

a) a rear substrate and a front substrate facing each other and separated from each other by a predetermined distance;

b) a rear electrode and a front electrode arranged on the rear substrate and the front substrate, respectively, in such a manner that the rear and front electrodes overlap each other while facing each other, wherein:

1) the front electrode is a ring-shaped loop electrode adapted to receive alternating current that is applied thereto; and 2) the rear electrode is a stripe electrode;

c) a fluorescent layer formed on the rear electrode;

d) a dielectric layer formed over the front electrode; and e) a protection layer formed on the dielectric layer.

3. A plasma display panel, comprising:

a) a rear substrate and a front substrate facing each other and separated from each other by a predetermined distance;

b) a rear electrode and a front electrode arranged on the rear substrate and the front substrate, respectively, in such a manner that the rear and front electrodes overlap each other while facing each other, wherein:

1) the front electrode is a ring-shaped loop electrode adapted to receive alternating current that is applied thereto; and 2) the rear electrode is a ring-shaped loop electrode adapted to receive alternating current that is applied thereto;

c) a fluorescent layer formed on the rear electrode;

d) a dielectric layer formed over the front electrode; and e) a protection layer formed on the dielectric layer.

* * * * *